US011255341B1

(12) United States Patent
Cheng

(10) Patent No.: US 11,255,341 B1
(45) Date of Patent: Feb. 22, 2022

(54) CENTRIFUGAL FAN IMPELLER STRUCTURE

(71) Applicant: ASIA VITAL COMPONENTS CO., LTD., New Taipei (TW)

(72) Inventor: Min-Sheng Cheng, New Taipei (TW)

(73) Assignee: Asia Vital Components Co., Ltd., New Taipei (TW)

( * ) Notice: Subject to any disclaimer, the term of this patent is extended or adjusted under 35 U.S.C. 154(b) by 0 days.

(21) Appl. No.: 17/024,733

(22) Filed: Sep. 18, 2020

(51) Int. Cl.
*F04D 29/30* (2006.01)
*F04D 29/28* (2006.01)

(52) U.S. Cl.
CPC ..... *F04D 29/30* (2013.01); *F04D 29/281* (2013.01); *F05D 2240/301* (2013.01)

(58) Field of Classification Search
CPC ..... F04D 17/16; F04D 29/281; F04D 29/30; F05D 2240/301
See application file for complete search history.

(56) References Cited

U.S. PATENT DOCUMENTS 9,777,742 B2 * 10/2017 Yang ..... F04D 29/2216
2013/0272862 A1 * 10/2013 Chung ..... B22F 5/00 415/200
2017/0184117 A1 * 6/2017 Lu ..... F04D 25/08
2018/0058467 A1 * 3/2018 Lin ..... F04D 17/16

FOREIGN PATENT DOCUMENTS

| | | | |
|---|---|---|---|
| CN | 107781215 | A | 3/2018 |
| CN | 207920910 | U | 9/2018 |
| CN | 207920957 | U | 9/2018 |
| CN | 208634095 | U | 3/2019 |
| CN | 209569198 | U | 11/2019 |
| CN | 110762040 | A | 2/2020 |
| CN | 211144865 | U | 7/2020 |
| FR | 551607 | A | 4/1923 |

* cited by examiner

*Primary Examiner* — Ninh H. Nguyen

(74) *Attorney, Agent, or Firm* — Bradley J. Thorson; DeWtt LLP

(57) ABSTRACT

A centrifugal fan impeller structure includes a hub and multiple blades extending from an outer circumference of the hub. Each blade has a fixed end, a free end, an upper end face, a lower end face, a front end face and a rear end face. The front and rear end faces define therebetween a thickness. The thickness ranges from 0.05 mm to 0.15 mm. The are two inclinations between the upper and lower end faces of the blade, whereby the thickness of the blade is minified to increase the number of the blades. By means of the inclinations, the blades are not subject to breakage in the demolding process.

14 Claims, 7 Drawing Sheets

CENTRIFUGAL FAN IMPELLER STRUCTURE

BACKGROUND OF THE INVENTION

1. Field of the Invention

The present invention relates generally to a fan impeller structure, and more particularly to a centrifugal fan impeller structure.

2. Description of the Related Art

The conventional fan impeller structure is generally made of metal or plastic material. The blades of the metal fan impeller can be made with very thin thickness. However, the metal fan impeller is heavier. This will affect the rotational speed of the fan and the output air volume as well as the consumed power. Moreover, the material cost for the metal fan impeller is higher. Also, in the manufacturing process, it is necessary to separately manufacture the blades and the hub of the metal fan impeller. As a result, the manufacturing cost for the metal fan impeller is higher.

With respect to plastic fan impeller, the plastic fan impeller has the advantage of lighter weight. Also, the material cost for the plastic fan impeller is lower. Also, in the manufacturing process, the blades and the hub of the plastic fan impeller can be integrally formed by means of injection molding. Therefore, the manufacturing cost for the plastic fan impeller is lowered. However, due to the limitation of technique, the blades of the plastic fan impeller cannot be made with a thickness as thin as the metal fan impeller. This will affect the output air volume. There is a conventional plastic fan impeller in which the blades can be made with a thickness under 0.3 mm. However, in practice, due to the limitation of technique, the blades of the conventional plastic fan impeller can be only made with a thinnest thickness of 0.3 mm rather than 0.3 mm. In addition, under this thickness condition, the number of the blades of the plastic fan impeller ranges from 35 to 70. In practice, due to the insufficient structural strength of the material and the conventional mold is manually polished so that the precision is poor and it is hard to further reduce the thickness of the plastic blades or increase the number of the blades. In addition, due to shape design of the conventional plastic blades and the insufficient material structural strength, it is uneasy to demold the blades. As a result, the blades are subject to breakage in the demolding process. Therefore, the manufacturing cost cannot be lowered.

It is therefore tried by the applicant to provide a centrifugal fan impeller structure to solve the above problems existing in the conventional fan impeller structure.

SUMMARY OF THE INVENTION

It is therefore a primary object of the present invention to provide a centrifugal fan impeller structure, in which the thickness of the blades is minified and the number of the blades is increased to enhance the air volume. In addition, the blades are not subject to breakage in the demolding process.

To achieve the above and other objects, the centrifugal fan impeller structure of the present invention includes a hub and multiple blades extending from an outer circumference of the hub. Each blade has a fixed end, a free end, an upper end face, a lower end face, a front end face and a rear end face. The fixed end and the free end are respectively positioned at two opposite ends of the blade. The fixed end is securely connected with the hub. The upper and lower end faces are respectively positioned on upper and lower sides of the blade. The front and rear end faces are respectively positioned on front and rear sides of the blade. The front and rear end faces define therebetween a thickness. The thickness ranges from 0.05 mm to 0.15 mm. The blade is tapered from the upper end face to the lower end face, whereby there are two inclinations between the upper and lower end faces. The number of the blades is ≥71.

By means of the design of the present invention, the thickness of the blade is minified to increase the number of the blades and enhance the air volume. Also, the blades are not subject to breakage in the demolding process.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
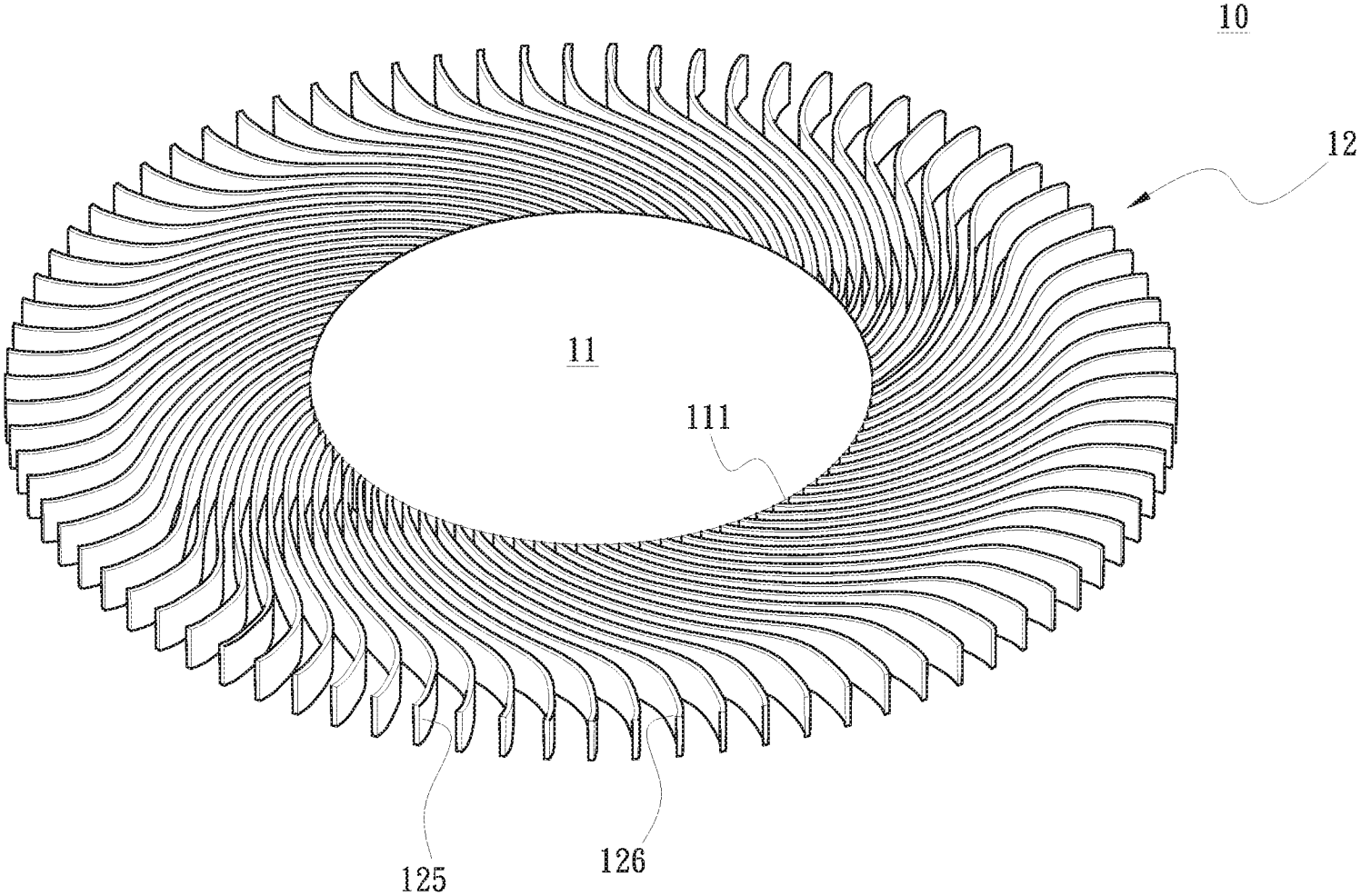
FIG. 1 is a perspective view of the centrifugal fan impeller structure of the present invention.
Figure 2:
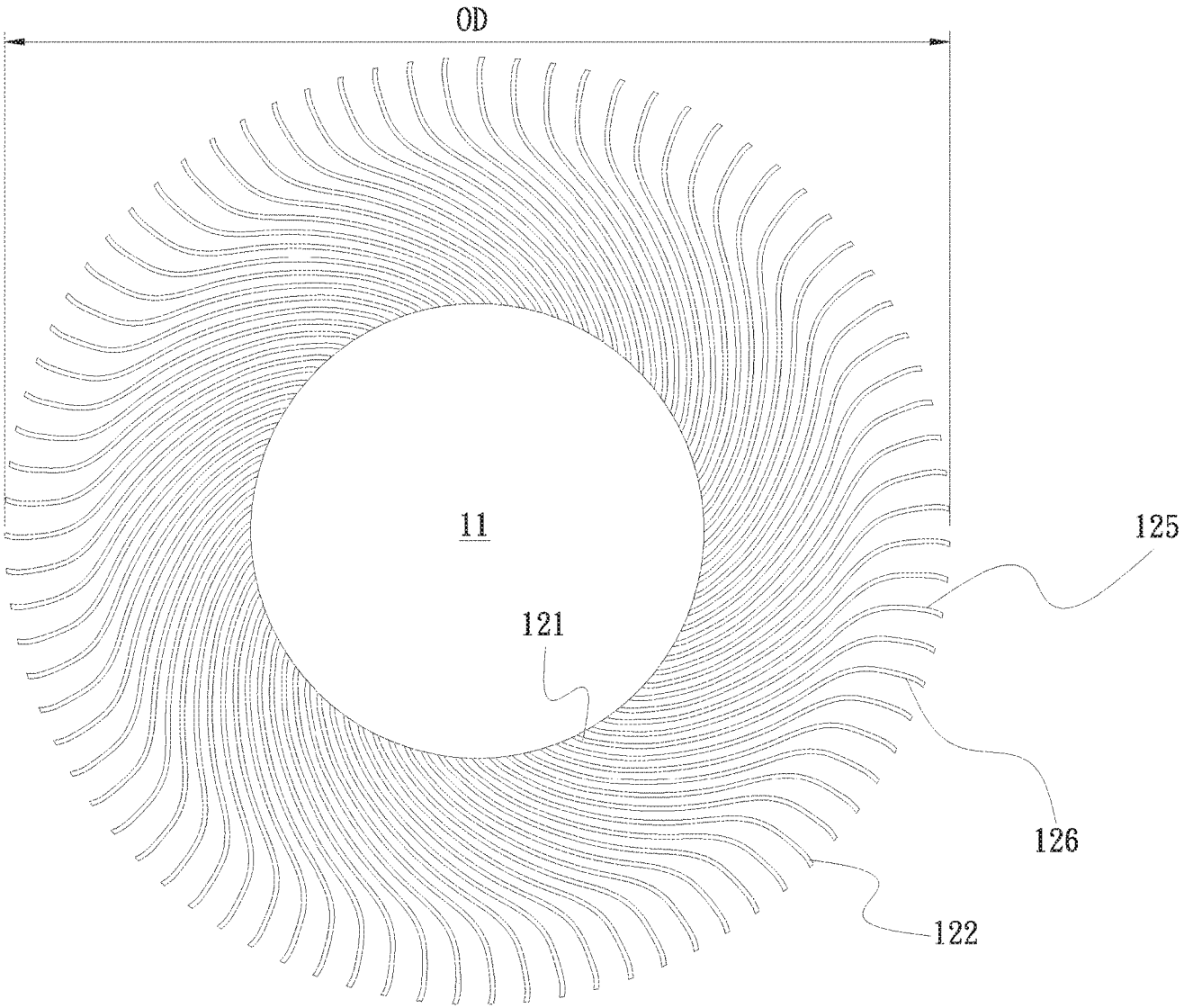
FIG. 2 is a top view of the centrifugal fan impeller structure of the present invention.
Figure 3:
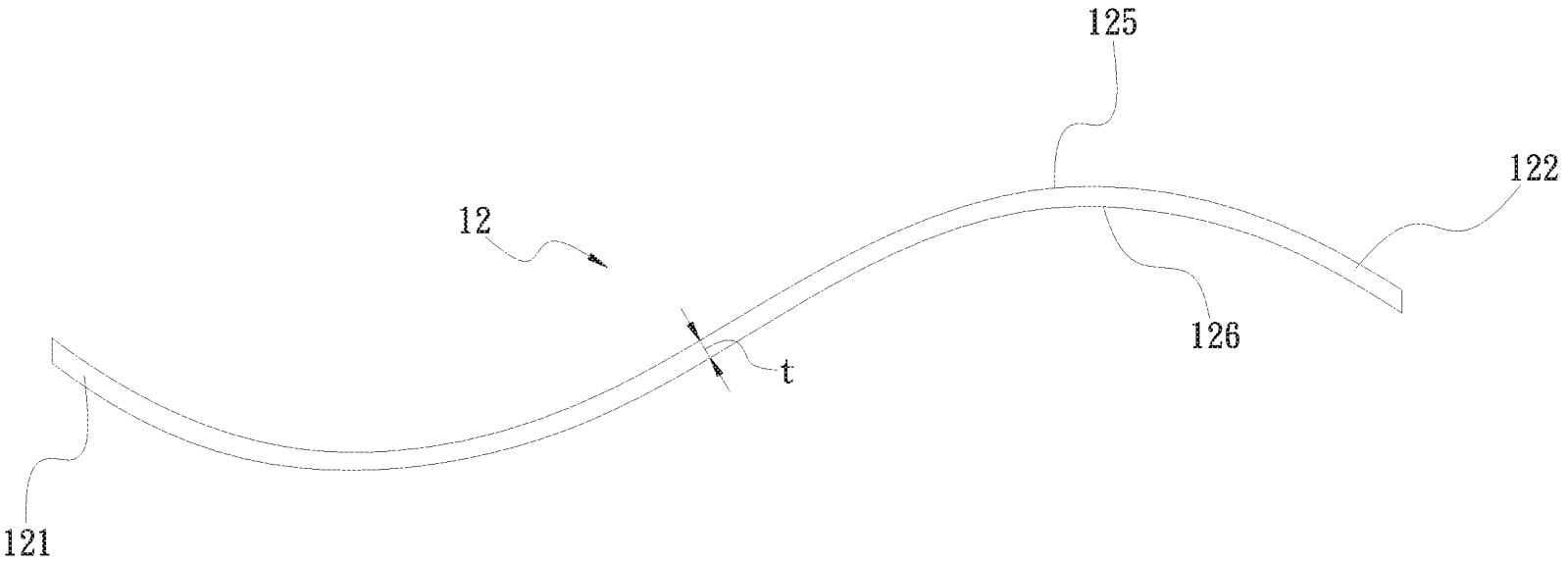
FIG. 3 is an enlarged view of the blade of the centrifugal fan impeller structure of the present invention.

Please refer to FIGS. 1 and 2. FIG. 1 is a perspective view of a first embodiment of the centrifugal fan impeller structure of the present invention. FIG. 2 is a top view of the first embodiment of the centrifugal fan impeller structure of the present invention. As shown in the drawings, the centrifugal fan impeller structure 10 of the present invention is rotatable and includes a hub 11 and multiple blades 12. The hub 11 can be a metal hub or a plastic hub or a combination thereof. In this embodiment, the blades are selectively plastic blades.

Figure 4:
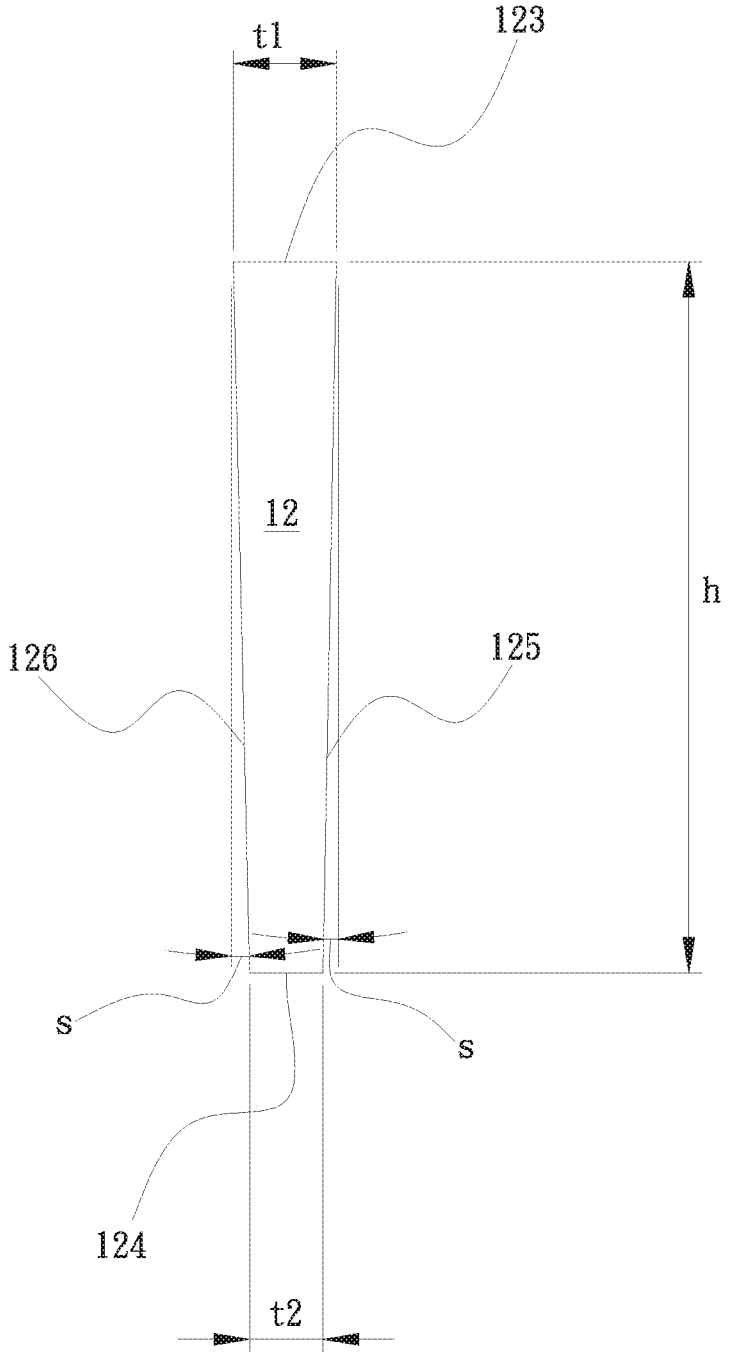
FIG. 4 is a sectional view of the blade of the centrifugal fan impeller structure of the present invention.

The hub 11 has an outer circumference 111. The blades 12 extend from the outer circumference 111. Each blade 12 has a fixed end 121, a free end 122, an upper end face 123, a lower end face 124, a front end face 125 and a rear end face 126. The fixed end 121 and the free end 122 are respectively positioned at two ends of the blade 12. The fixed end 121 is securely connected with the outer circumference 111 of the hub 11. The upper and lower end faces 123, 124 are respectively positioned on upper and lower sides of the blade 12. The front and rear end faces 125, 126 are respectively positioned on front and rear sides of the blade 12. Referring to FIG. 4, which is a sectional view of the blade of the centrifugal fan impeller structure of the present invention, the front end face 125 is shown as a right side of the blade 12, while the rear end face 126 is shown as a left side of the blade 12.

The front and rear end faces 125, 126 define therebetween a thickness t. The thickness t ranges from 0.05 mm to 0.15 mm. In addition, the thickness t of the blade 12 is tapered from the upper end face 123 to the lower end face 124. Therefore, the thickness t1 of the upper end face 123 is larger than the thickness t2 of the lower end face 124. Therefore, there are two inclinations s between the upper and lower end faces 123, 124. The inclinations s range from 0.4 degree to 0.6 degree. In this embodiment, the inclinations s are equal to each other. In a modified embodiment, the inclinations s can be unequal to each other.

The upper and lower end faces 123, 124 define therebetween a height h. The height h of the blade 12 is ≤4 mm and the number of the blades 12 is ≥71. The number of the blades 12 is a prime number ranging from 71 to 113. The blades 12 are annularly arranged on the outer circumference 111 of the hub 11 to define an outer diameter OD. The outer diameter OD of the blades 12 is ≤52 mm.

In this embodiment, the thickness t of the blade 12 is, but not limited to, 0.1 mm. The thickness of the upper end face 123 of the blade 12 is 0.1 mm. The thickness of the lower end face 124 of the blade 12 is 0.08 mm. The inclination s is 0.5 degree. The number of the blades 12 is 83. The height of the blade 12 is 4 mm. The outer diameter OD of the blade 12 is 52 mm. In practice, the above parameters can be varied according to actual requirement.

Figure 5:
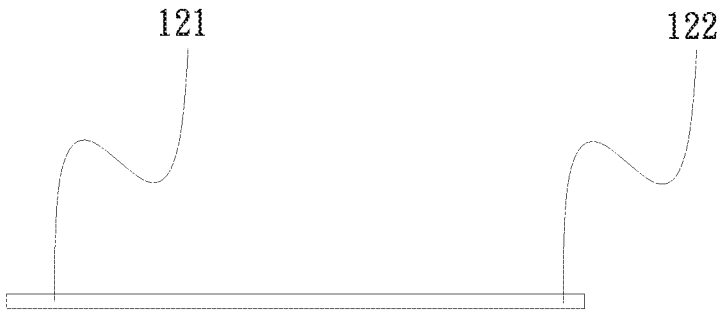
FIG. 5 is a cross-sectional view of the blade of the centrifugal fan impeller structure of the present invention, showing that the cross-section of the blade is straight-plate-shaped.
Figure 6:
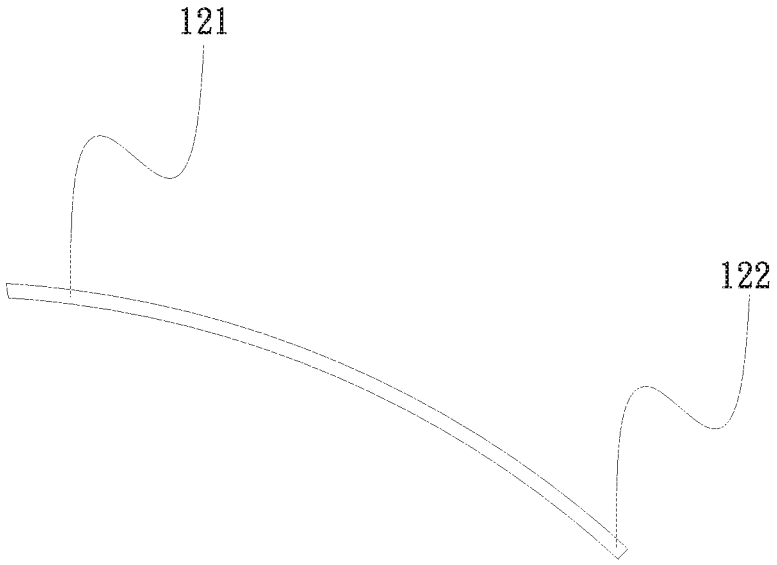
FIG. 6 is a cross-sectional view of the blade of the centrifugal fan impeller structure of the present invention, showing that the cross-section of the blade is arc-shaped.

In addition, in this embodiment, the cross-section of the blade 12 is, but not limited to, S-shaped. In practice, the cross-section of the blade 12 can be alternatively straight-plate-shaped (as shown in FIG. 5) or arc-shaped (as shown in FIG. 6). Alternatively, the cross-section of the blades 12 can be any combination of S-shaped, straight-plate-shaped and arc-shaped.

The blade 12 has a front section 127, a middle section 128 and a rear section 129. The rear section 129 is adjacent to the fixed end 121. The front section 127 is adjacent to the free end 122. The middle section 128 is connected between the front and rear sections 127, 129. In this embodiment, the thicknesses t of the front, middle and rear sections 127, 128, 129 are equal to each other. In a modified embodiment, the thicknesses t of the front, middle and rear sections 127, 128, 129 are unequal to each other.

Figure 7:
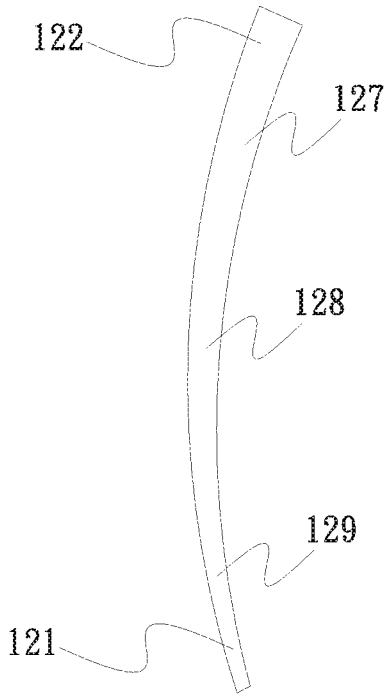
FIG. 7 is a sectional view of the blade of the centrifugal fan impeller structure of the present invention, showing that the thickness of the blade is gradually thickened from the free end to the fixed end.
Figure 8:
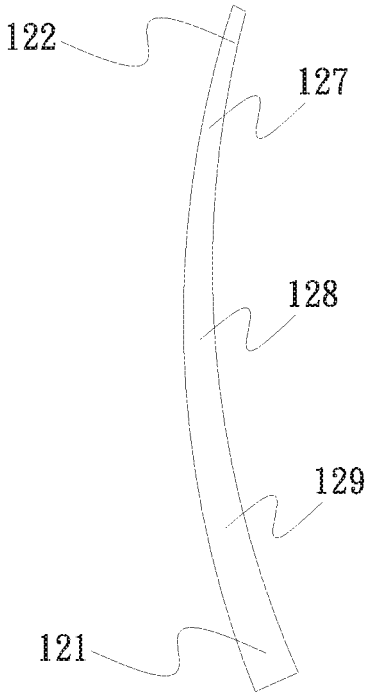
FIG. 8 is a sectional view of the blade of the centrifugal fan impeller structure of the present invention, showing that the thickness of the blade is gradually thinned from the free end to the fixed end.

For example, the thickness t of the blade 12 can be selectively gradually thickened from the fixed end 121 to the free end 122. That is, the thickness of the front section 127 is larger than the thickness of the middle section 128 and the thickness of the middle section 128 is larger than the thickness of the rear section 129 (as shown in FIG. 7). Alternatively, the thickness t of the blade 12 can be gradually thinned from the fixed end 121 to the free end 122. That is, the thickness of the front section 127 is smaller than the thickness of the middle section 128 and the thickness of the middle section 128 is smaller than the thickness of the rear section 129 (as shown in FIG. 8). Alternatively, the thickness t of some of the blades 12 is gradually thickened from the free end 122 to the fixed end 121, while the thickness t of the rest of the blades 12 is gradually thinned from the free end 122 to the fixed end 121.

Figure 9:
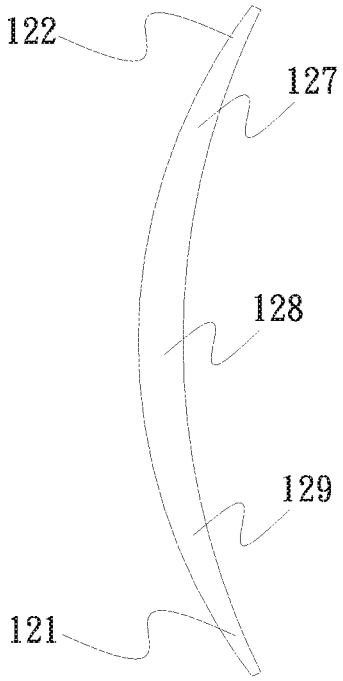
FIG. 9 is a sectional view of the blade of the centrifugal fan impeller structure of the present invention, showing that the thickness of the blade is first gradually thickened from the fixed end to the free end and then gradually thinned from the fixed end to the free end.
Figure 10:
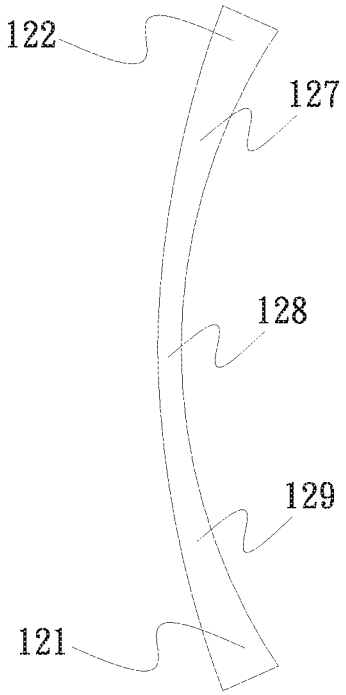
FIG. 10 is a sectional view of the blade of the centrifugal fan impeller structure of the present invention, showing that the thickness of the blade is first gradually thinned from the fixed end to the free end and then gradually thickened from the fixed end to the free end.

Still alternatively, the thickness of the blade 12 is selectively first gradually linearly thickened from the fixed end 121 to the free end 122 and then gradually thinned from the fixed end 121 to the free end 122. That is, the thickness of the front and rear sections 127, 129 is smaller than the thickness of the middle section 128 (as shown in FIG. 9). Alternatively, the thickness of the blade 12 is first gradually linearly thinned from the fixed end 121 to the free end 122 and then gradually thickened from the fixed end 121 to the free end 122. That is, the thickness of the front and rear sections 127, 129 is larger than the thickness of the middle section 128 (as shown in FIG. 10). Still alternatively, the thickness t of some of the blades 12 is first thickened from the fixed end 121 to the free end 122 and then gradually thinned from the fixed end 121 to the free end 122, while the thickness t of the rest of the blades 12 is first thinned from the fixed end 121 to the free end 122 and then gradually thickened from the fixed end 121 to the free end 122.

Figure 11:
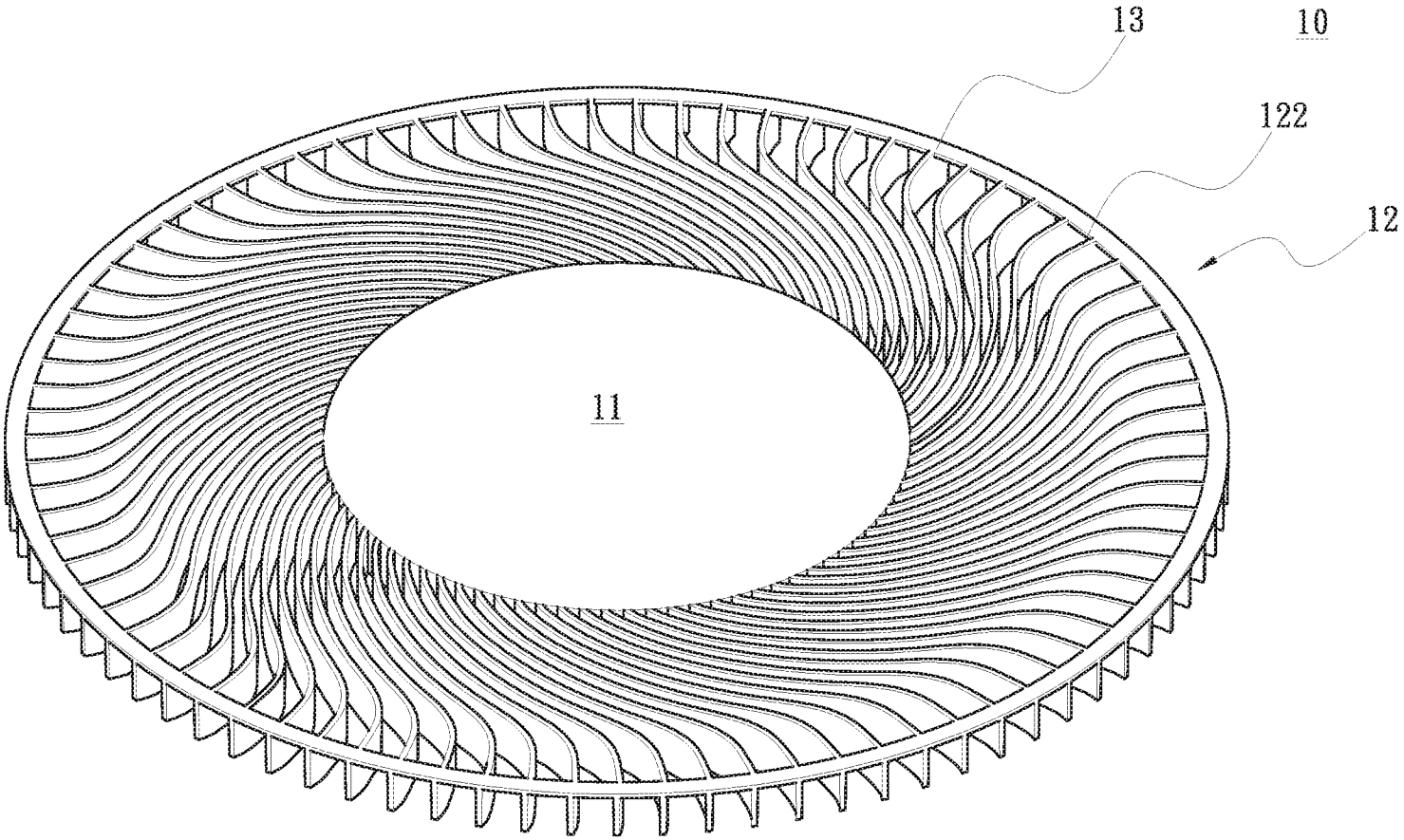
FIG. 11 is a perspective view of the centrifugal fan impeller structure of the present invention, showing the fixing ring of the blades.

In a modified embodiment, the free ends 122 of the blades 12 are connected with each other to form a fixing ring 13 (as shown in FIG. 11). In rotation, the fixing ring 13 serves to enhance the structural strength and stability of the blades 12.

Moreover, the blades 12 and/or the fixing ring 13 are made of liquid crystal polymer (LCP) material by means of injection molding. The liquid crystal polymer material can be blended with fiber carbon material to enhance the structural strength of the blades 12. The liquid crystal polymer material has excellent flowability and the surface of the mold is polished by a fluid so that the surface of the mold has higher precision and the thickness t of the blades 12 can reach 0.05 mm to 0.15 mm. Moreover, after the thickness t of the blades 12 is further minified, the number of the blades 12 arranged on the outer circumference of the hub 11 can be ≥71. This enlarges the outgoing air volume of the centrifugal fan impeller. Also, the inclination s of the blades 12 is a demolding angle. By means of the inclination s, the blades 12 are not subject to breakage in the demolding process.

The liquid crystal polymer (LCP) material is a general term of thermoplastic aromatic polyester, which shows liquid crystallinity in molten state. The liquid crystal polymer has a rigid and inflexible molecular structure. The liquid crystal polymer has a unique feature different from the general polymer material that the molecules are tangled therewith to a very light extent and there are very few bonding between the molecular bonds. Very small shearing force can cause the orientation of the molecules so that in injection molding process, the flowing resistance is very small and the liquid crystal polymer material has excellent flowability. Moreover, when solidified, the molecules will keep the same molecular form as the molten state. Therefore, when the molecules are rearranged, the volume change is very small so that very high size precision is achievable. According to the above features, the liquid crystal polymer (LCP) material is very suitable for manufacturing the centrifugal fan impeller structure.

The fluid polishing technique is such that a fine grinding treatment can be performed in accordance with different technical requirements. Also, the fluid polishing technique can achieve mirror-face polishing or solve the problem of difficulty in attachment to the treated surface according to different material properties and pretreatment. The principle is that a highly flowable liquid adhesive is added to the soft resin. Thereafter, grinding particles are selectively added according to grinding or polishing requirements to manufacture a special soft flowable grinding material containing high-content grinding powder with flowability. The soft flowable grinding material vertically passes through the surface of the work piece. By means of the super-class diamond particles and special polishing powder, the surface of the mold is polished to achieve mirror-face effect. With respect to a tungsten steel work piece, the polishing removal amount ranges from 25 to 40 μm and the surface brightness is up to Ra0.08 μm. The precision mold requires high-precision work piece. The surface polishing treatment is up to Ra0.04 μm and the removal amount is about 10 μm.

In comparison with the metal fan impeller, the plastic centrifugal fan impeller structure of the present invention has the advantages of lightweight and lower material and manufacturing cost. Thanks to the advance of the technique, the plastic centrifugal fan impeller structure can be made with a thickness equivalent to the metal fan impeller. Therefore, the plastic centrifugal fan impeller structure of the present invention can be used instead of the conventional metal fan impeller to lower the manufacturing cost.

The present invention has been described with the above embodiments thereof and it is understood that many changes and modifications in such as the form or layout pattern or practicing step of the above embodiments can be carried out without departing from the scope and the spirit of the invention that is intended to be limited only by the appended claims.

What is claimed is:

1. A centrifugal fan impeller structure comprising:

a hub; and multiple blades extending from an outer circumference of the hub, each blade having a fixed end, a free end, an upper end face, a lower end face, a front end face and a rear end face, the fixed end and the free end being respectively positioned at two ends of the blade, the fixed end being securely connected with the hub, the upper and lower end faces being respectively positioned on upper and lower sides of the blade, the front and rear end faces being respectively positioned on front and rear sides of the blade, the front and rear end faces defining therebetween a thickness, the thickness ranging from 0.05 mm to 0.15 mm, the thickness of the blade being tapered from the upper end face to the lower end face, whereby there are two inclinations between the upper and lower end faces, the number of the blades being ≥71.

2. The centrifugal fan impeller structure as claimed in claim 1, wherein the blade has a front section, a middle section and a rear section, the rear section being adjacent to the fixed end, the front section being adjacent to the free end, the middle section being connected between the front and rear sections, the thicknesses of the front, middle and rear sections being equal to or unequal to each other.

3. The centrifugal fan impeller structure as claimed in claim 2, wherein the thickness of the blade is selectively uniform or gradually thickened from the fixed end to the free end or gradually thinned from the fixed end to the free end or any combination thereof.

4. The centrifugal fan impeller structure as claimed in claim 2, wherein the thickness of the blade is selectively first gradually linearly thickened from the fixed end to the free end and then gradually thinned from the fixed end to the free end or first gradually linearly thinned from the fixed end to the free end and then gradually thickened from the fixed end to the free end or any combination thereof.

5. The centrifugal fan impeller structure as claimed in claim 1, wherein the inclinations between the upper and lower end faces of the blade range from 0.4 degree to 0.6 degree.

6. The centrifugal fan impeller structure as claimed in claim 1, wherein the inclinations are equal to or unequal to each other.

7. The centrifugal fan impeller structure as claimed in claim 1, wherein the number of the blades is a prime number ranging from 71 to 113.

8. The centrifugal fan impeller structure as claimed in claim 1, wherein the thickness of the upper end face of the blade is 0.1 mm, while the thickness of the lower end face of the blade is 0.08 mm.

9. The centrifugal fan impeller structure as claimed in claim 1, wherein the height of the blade is ≤4 mm.

10. The centrifugal fan impeller structure as claimed in claim 1, wherein the outer diameter of the blades is ≤52 mm.

11. The centrifugal fan impeller structure as claimed in claim 1, wherein the blades are made of liquid crystal polymer material by means of injection molding.

12. The centrifugal fan impeller structure as claimed in claim 10, wherein the liquid crystal polymer material is blended with fiber carbon material.

13. The centrifugal fan impeller structure as claimed in claim 1, wherein the cross-section of the blade is straight-plate-shaped, S-shaped or arc-shaped or any combination thereof.

14. The centrifugal fan impeller structure as claimed in claim 1, wherein the free ends of the blades are connected with each other to form a fixing ring.

* * * * *